United States Patent [19]

Horita et al.

[11] Patent Number: 4,541,351

[45] Date of Patent: Sep. 17, 1985

[54] METHOD AND APPARATUS FOR AUTOMATIC POSITIONING OF OPEN ENDS OF STOCKINGS FOR FORMING INTO PANTYHOSE

[75] Inventors: Teruyuki Horita, Kitakatsuragi; Keiji Kawamura, Yamatotakada, both of Japan

[73] Assignees: Takatori Machinery Mfg. Co., Ltd.; Kawamura Textile Co., Ltd., both of Yamatotakada, Japan

[21] Appl. No.: 612,027

[22] Filed: May 18, 1984

[30] Foreign Application Priority Data

May 26, 1983 [JP] Japan ..... 58-93487

[51] Int. Cl.[4] ..... D05B 21/00; D05B 97/00

[52] U.S. Cl. ..... 112/262.2; 112/121.15; 112/153; 223/43

[58] Field of Search ..... 112/121.15, 121.12, 112/121.11, 121.29, 2, 262.2, 262.3, 153, 306, 51; 223/43

[56] References Cited

U.S. PATENT DOCUMENTS

| | | | |
|---|---|---|---|
| 3,777,681 | 12/1973 | Horita | 112/121.15 |
| 3,875,881 | 4/1975 | Marjorio | 112/153 |
| 4,013,026 | 3/1977 | Hall | 112/153 |
| 4,188,897 | 2/1980 | Takatori | 112/262.2 |
| 4,224,885 | 9/1980 | Takatori | 112/262.2 |
| 4,364,320 | 12/1982 | Nakhle | 112/262.2 |

*Primary Examiner*—H. Hampton Hunter

*Attorney, Agent, or Firm*—Wenderoth, Lind & Ponack

[57] ABSTRACT

In pantyhose hip portion seaming operation, the open ends of a pair of stockings mounted respectively on upper and lower templates of a template unit are detected by means of phototubes to allow the both ends to be automatically positioned so that they are properly aligned.

After a pair of stockings are mounted on the upper and lower templates of a template unit, a pair of phototubes arranged in upper and lower positions are moved to the ends of the stockings in such a way that upon one of the stocking ends being detected by one of the phototubes, the one phototube is caused to stop moving, the other phototube is caused to detect the presence of the other stocking.

According to the condition of the other stocking as detected by the other phototube, the other stocking is moved forward or backward as required, and upon the end of the other stocking being detected by the other phototube, the hose is caused to stop moving, whereby the ends of the both stockings are properly aligned.

2 Claims, 16 Drawing Figures

FIG. 1 (A) (PRIOR ART)
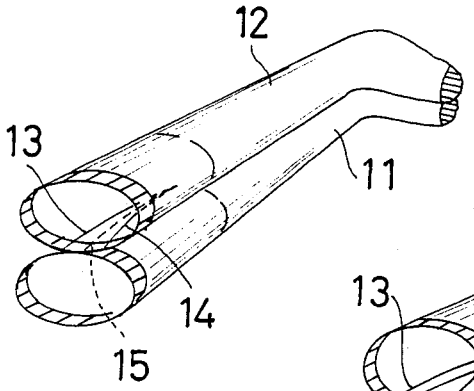
FIG. 1 (B) (PRIOR ART)
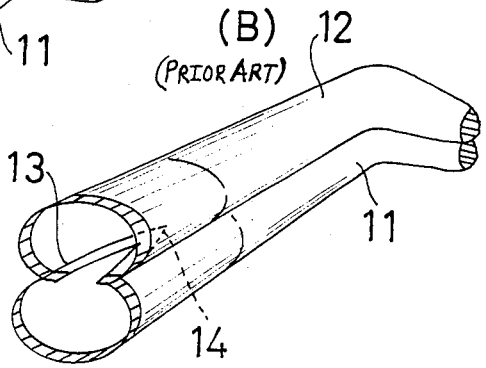
FIG. 1 (C) (PRIOR ART)
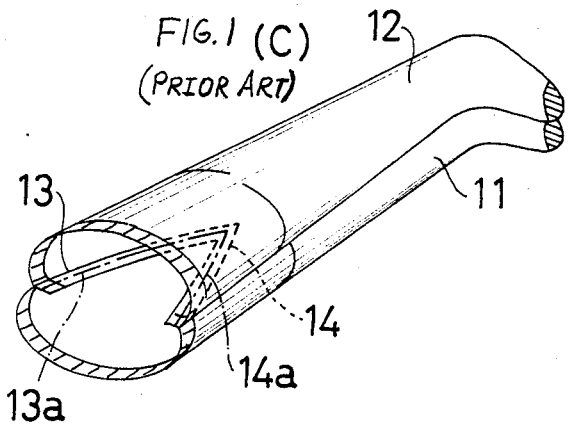

(A)

(A)

METHOD AND APPARATUS FOR AUTOMATIC POSITIONING OF OPEN ENDS OF STOCKINGS FOR FORMING INTO PANTYHOSE

The present invention relates to a method of automatically positioning the open ends of a pair of stockings for aligning them in relation to each other, and an apparatus for practicing the method. More specifically, the invention relates to a method and apparatus for carrying out the first preparatory step involved in pantyhose hip portion seaming operation employing an apparatus known as an automatic pantyhose hip portion seaming machine, that is, automatically positioning the open ends of a pair of stockings mounted respectively on upper and lower templates of a template assembly so that said ends are properly aligned together.

A pantyhose seaming operation is usually carried out in the following way. As FIG. 1A illustrates, a pair of stockings 11, 12 (tubularly knit stocking materials) of identical size and shape are held together in superposed relation by nipping them together at portion thereof which will form panty portions and along lines 13 and 14. Under this nipped condition, slicing is carried out along a line 15 extending between said lines 13 and 14 (see FIG. 1B). After this slicing the open ends of the stockings 11 and 12 are spread laterally in the direction perpendicular to the lines 13, 14 so as to open the sliced part, and then the sliced part is seamed to form seams 13*a*, 14*a* (see FIG. 1C).

For the purpose of forming a pair of stockings into pantyhoses in aforesaid manner, an apparatus known as automatic pantyhose hip portion seaming machine has been widely used. This seaming machine has a plurality of template units, each consisting of a pair of template assemblies, upper and lower, each of which comprises an opposed pair of right and left templates, said template units being arranged so that a series of steps involved in pantyhose seaming operation may be carried out simultaneously and in overlapping relation at certain time intervals, or at certain phase differentials between the operation steps involved. As such, the machine permits high productivity and thus contributes greatly to the rationalization of pantyhose manufacturing operation.

However, the seaming machine is such that the first preparatory step involved in pantyhose seaming operation, that is, mounting of a pair of stockings on the upper and lower template assemblies of each template unit must be carried out manually. Further, it is necessary that the open ends of the stockings must be properly positioned by aligning them in relation to each other. While mounting of the stockings on the upper and lower template assemblies may be carried out relatively easily and quickly, the positioning of open ends of the stockings so mounted requires the operator's skill which depends largely on his visual or finger tip control. As such, the positioning operation requires considerable time and this eventually leads to decreased efficiency of seaming machine operation. Indeed, irregularly positioned stocking ends, if seamed as they are, will result in irregularities in panty seams, which render the finished product defective. Therefore, after having mounted a pair of stockings on the upper and lower templates, the operator is required to use his utmost care and prudence in positioning them into proper alignment. Naturally, this involves considerable time. Furthermore, this imposes considerable nerve strain on the operator.

Accordingly, it is an object of the invention to provide an automatic positioning method which permits easy and accurate alignment of the open ends of a pair of stockings mounted on upper and lower templates of each template unit in an automatic pantyhose seaming machine.

It is another object of the invention to provide an automatic positioning method which permits accurate positioning of open stocking ends irrespective of the manner in which the stocking ends are mounted on the upper and lower templates.

It is a further object of the invention to an automatic positioning apparatus of simple construction for practicing said automatic positioning method.

The above and other object and features of the invention will appear more fully hereinafter from a consideration of the following description taken in connection with the accompanying drawings wherein one example is illustrated by way of example.

FIGS. 1A to 1C are perspective views illustrating pantyhose hip portion seaming operation.

To facilitate the understanding of the method and apparatus in accordance of the invention, the prior-art automatic pantyhose seaming machine will be first briefly described.

Figure 2:
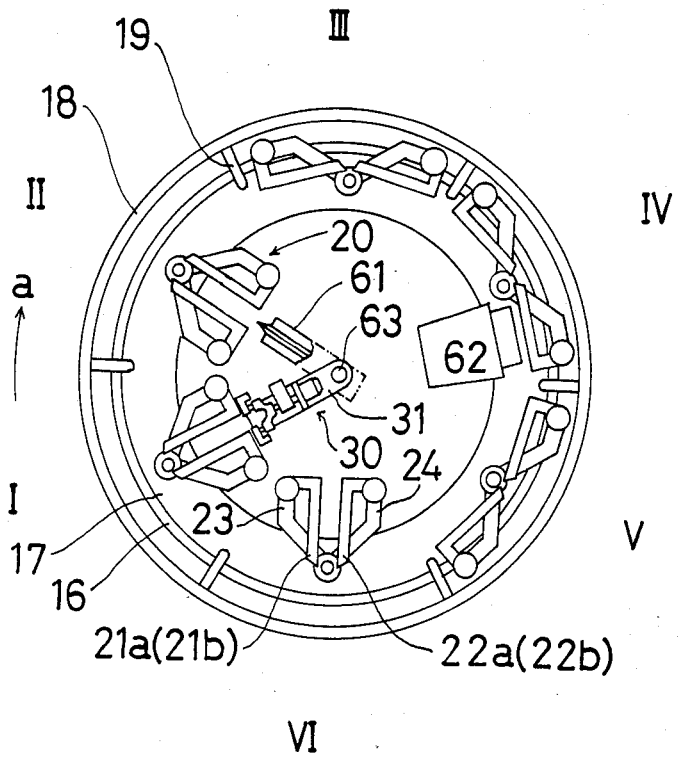
FIG. 2 is a schematic plan view showing an automatic pantyhose hip portion seaming machine in which a positioning apparatus according to the invention is mounted.

As FIG. 2 shows, the seaming machine has a guide rail 16 of an endless circular form on which a circularly elongated carrier 17 is slidably mounted. A material receiving pipe 18 having a circular shape larger than that of the guide rail 16 is mounted to the carrier 17 through mounting fittings 19. On the carrier 17 there are mounted at prescribed distances a plurality of template units 20 (6 units are shown) consisting of a pair of arms 23, 24, right and left, each arm having a pair of upper and lower templates 21*a*, 21*b* or 22*a*, 22*b*, as the case may be. Each pair of templates, right and left, of each template unit 20 is movable toward and away from the guide rail 16 through open-close motion of the arms 23, 24 so that the templates are positioned in the opened state on the circular track of the guide rail 16 as they are advanced to the rail and are held in parallel relation as they return to their original position. Each pair of upper and lower templates is movable for contact engagement with and disengagement from each other.

Each of the template units 20 is movable integrally with the carrier 17 and material receiving pipe 18 in the direction of arrow a in FIG. 2, that is, in the clockwise direction so that it may be positioned sequentially at six operating stations I–VI on the guide rail 16. Referring to FIG. 2, at station I a pair of stockings 11, 12 are manually mounted on the template unit 20 in such manner that one is inserted over the lower templates 21*b*, 22*b* and the other over the upper templates 21*a*, 22*a*. The stockings 11, 12 so mounted are nipped into side-by-side contact in the course of travel of the template unit 20 to station II.

On the course from station II to station III, upper inner portions of the stockings 11, 12 are cut to form a panty portion, said slicing being carried out by cutter means 61 movable in conjunction with the carrier 17. After cutting, the template assemblies of the template unit 20 are opened on the circular track so that the cut edges of the stockings 11, 12 nipped together are exposed outside. As the template unit 20 travels from station IV to station V, the so exposed cut edges of the stockings 11, 12 are sewn together by a sewing machine 62 into a seam. In the course of the template unit 20 travelling from station V to station VI, the template assemblies are caused to return to their original parallel state, and as the unit reaches station VI, the template assemblies release the stockings from nipping.

One form of automatic positioning apparatus for practicing the automatic positioning method of the present invention will now be described with reference to the accompanying drawings.

As already explained with reference to FIG. 2, stockings 11, 12 mounted on the upper and lower template assemblies of the template unit 20 are nipped together into contact in the course of travel of the unit to station II, for subsequent cutting operation. Therefore, it is necessary that the positioning of the stockings 11, 12 mounted on the template assemblies must be carried out before the template unit 20 reaches station II, or more specifically, before the stockings 11, 12 are nipped together. To this end, positioning means 30 according to the invention are disposed adjacent station I, as FIG. 2 shows. However, the location of the positioning means 30 is not limited to station I. The means 30 may be disposed anywhere between the location for stocking mounting and the location at which the stockings are nipped together. For the purpose of hose positioning operation, it must be remembered that the positioning means 30 should not interfere with the travel of the template unit 20. In some case the template unit 20 may be intermittently operated, and in some other case it may be continuously operated. Where the unit 20 is continuously operated, the positioning means 30 are required to move synchronously with the template unit 20 at same speed as that of the carrier 17. For this purpose, the positioning means 30 should be so designed that they run around the center of the circular guide rail 16 in a specified cycle and over a specified distance. In the embodiment shown, a longitudinal bracket 31 of the positioning means 30 is rotatably supported on a main shaft 63 so that the positioning means 30 are supported for rotation around the center of the circular guide rail 16.

The cutter means 61 are also rotatably supported on the main shaft 63. Desirably, the positioning means 30 are so designed that they move synchronously with the cutter means 61 and at same distance from the operating stations as that between the cutter means and the stations.

Figure 4:
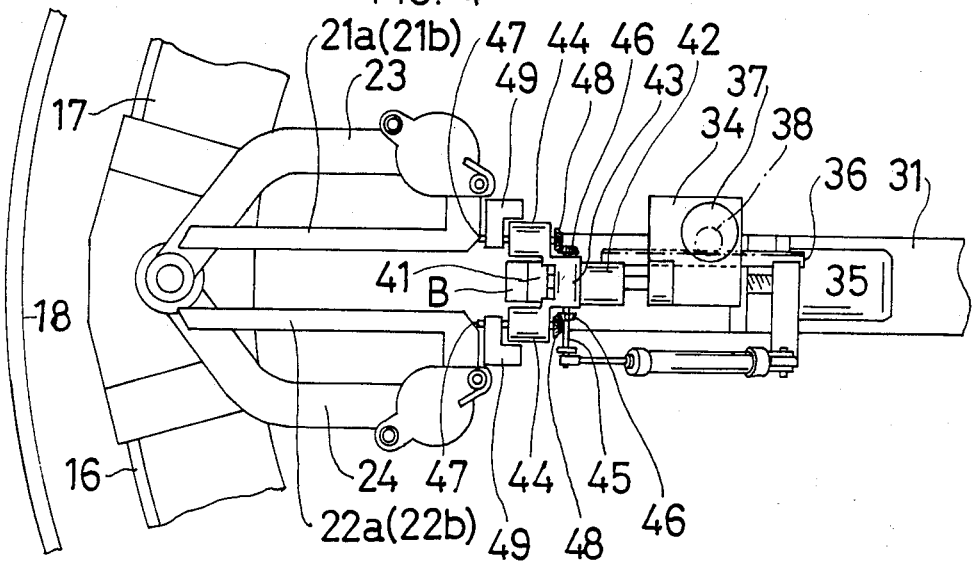
FIG. 4 is a plan view thereof.
Figure 3:
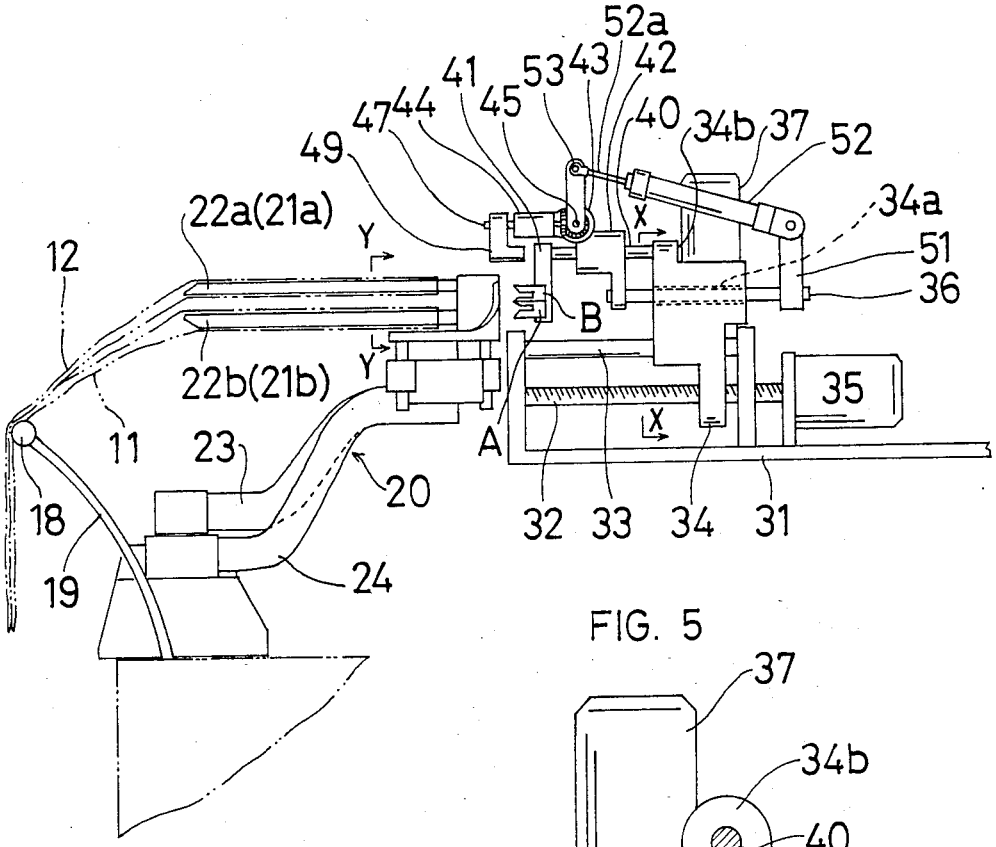
FIG. 3 is a side view showing one form of positioning apparatus embodying the invention.
Figure 5:
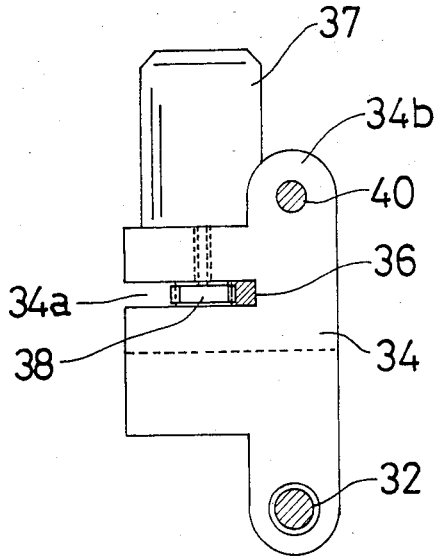
FIG. 5 is an enlarged view taken along the line X—X in FIG. 3.

Referring to FIGS. 3 to 5, a ball screw 32 and a guide shaft 33 are horizontally disposed on the longitudinal bracket 31 and in the longitudinal direction thereof, a moving pedestal 34 being fitted on the screw 32 so that the pedestal 34 may be moved back and forth along the guide shaft 33. On the longitudinal bracket 31 there is mounted a position control motor 35 (e.g. pulse motor or servo motor), to the output shaft of which said ball screw 32 is directly connected. Accordingly, the moving pedestal 34 may be moved back and forth by driving the motor 35 forward and reverse to rotate the ball screw 32 forward and reverse.

As FIG. 5 shows, the moving pedestal 34 has a groove 34*a* provided on one side thereof, in which groove there is horizontally slidably disposed a rack 36. On the pedestal 34 there is mounted another position control motor 37. A pinnion 38 connected directly to the output shaft of said motor 37 is in engagement with the rack 36 in the groove 34*a*, as FIG. 5 shows.

To a bracket 34*b* formed on the top of the moving pedestal 34 integrally therewith there extends another guide shaft 40 horizontally and along the guide shaft 33. A phototube holder 41 is supported at the front end of the guide shaft 40.

On the phototube holder 41 there are fixedly arranged two phototubes A, B, one over the other, as can be seen from FIG. 3.

A slider 42 is slidably fitted on the guide shaft 40. On one upper end of the slider 42 there is formed a boss 43 which supports at both sides thereof a pair of bosses 44, 44 having axes perpendicular to the axis of said boss 43.

A shaft 45 is rotatably inserted into the boss 43. Bevel gears 46, 46 are fitted on the shaft 45 at both ends thereof. Shafts 47, 47 are rotatably inserted into said pair of bosses 44, 44, and on said shafts 47, 47, at one end thereof, there are fitted bevel gears 48, 48 which mesh with the bevel gears 46, 46.

Positioning plates 49, 49 are fitted on the shafts 47, 47 at the other end thereof, said plates having their opposed inner surfaces covered with synthetic rubber or the like having high frictional properties.

As FIGS. 3 and 4 show, one end of the rack 36 is securely connected to the lower end portion of the slider 42, and the other end thereof supports, through a suitably bent bracket 51, the base portion of an air cylinder 52 which is pivotably connected to said other end of the rack 36. A piston rod 52*a* of an air cylinder 52 is connected to a lever 53 fitted on the shaft 45 at one end thereof.

Operation of the above described embodiment of the invention will now be explained with reference to FIGS. 8A to 8D and 9A to 9C.

At operating station I shown in FIG. 2, a pair of stockings 11, 12 are manually mounted respectively on the lower templates 21*b*, 22*b* and upper templates 21*a*, 22*a* of the template unit 20.

Figure 8:
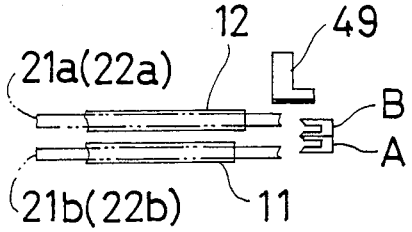
FIGS. 8A to 8D and 9A to 9C are schematic side views showing the operation of one form of apparatus according to the invention.
Figure 8B:
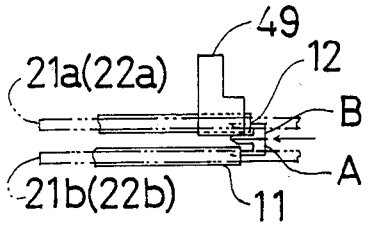
Figure 9:
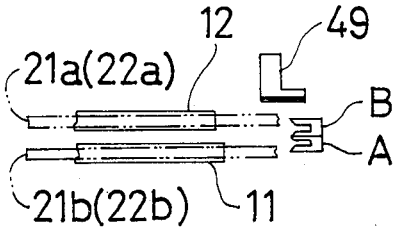
Figure 9B:
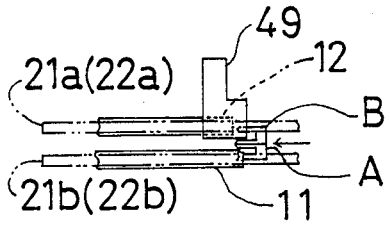

As to the manner of hose mounting, two cases may be considered as FIGS. 8A and 9A illustrate. One case is such that the open end of one stocking 11 as mounted on the lower templates 21*b*, 22*b* is located nearer to the template end than the end of the other stocking 12 mounted on the upper templates 21*a*, 22*a* is (FIG. 8A). The other case is contrary to this (FIG. 9A).

In either of such cases, the position of the open end of one stocking may be taken as a basis for positioning the open end of the other stocking. So, in the present instance, the position of the end of one stocking 11 mounted on the lower pair of templates 21*b*, 22*b* is used as the reference position and the end of the other stocking 12 mounted on the upper pair of templates 21*a*, 22*a* is aligned to the end of said one stocking 11 by moving the former on the templates back and forth.

More specifically, the positioning operation is performed in such a way that upon completion of the manual mounting of the stockings 11, 12, the motor 35 is driven forward to move the moving pedestal 34 forward along the guide shaft 33. As the pedestal 34 travels, the phototubes A, B fixed to the holder 41 are moved forward through the guide shaft 40 and holder 41. Instantly when, in the course of its travel, the phototube A detects the end 11*a* of said one stocking 11 (see FIG. 6), the motor 35 is stopped and the pedestal 34 and phototubes A, B are moved forward from a standby position shown in FIGS. 8A and 9A to a position shown in FIGS. 8B and 9B and then stopped.

Figure 7:
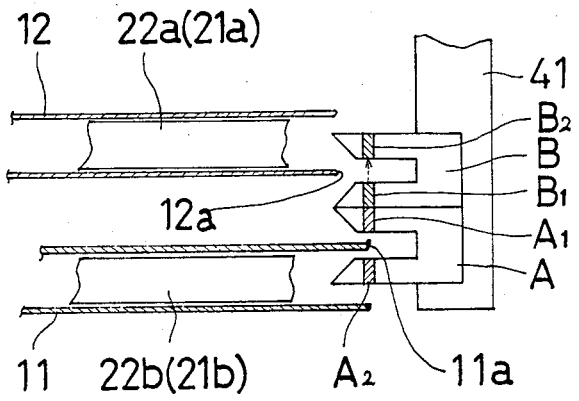
FIG. 7 is an enlarged view in side elevation showing phototubes A and B.

In the present embodiment, as can be seen from FIG. 7, the phototubes A, B are disposed in superposed state so that their respective detecting positions concur in the vertical direction, each phototube being of a so-called optical transmission type which consists of a light projecting portion A1 or B1 (as the case may be) and a light receiving portion A2 or B2 (as the case may be) disposed in opposed relation thereto. Detection of the end of a stocking by each of the phototubes is performed in such a way that interruption or noninterruption by the stocking end of the light directed from the light projecting portion of the phototube to the light receiving portion is converted into an electric signal, whereby the presence of stocking end or otherwise is detected. This process is further explained with reference to FIG. 7. In the figure, the lower phototube A is shown as it appears at the moment when the light directed from the light projector A1 to the light receiver A2 (shown by broken line) is interrupted by the end 11*a* of one stocking 11 mounted on the lower pair of templates 21*b*, 22*b*. At this moment the phototube A detects the end 11*a* of the stocking 11. The other phototube B is shown as it appears when it is not in such state as to permit it to detect the end 12*a* of the other stocking 12 mounted on the upper pair of templates 21*a*, 22*a*. The stocking end 12*a* has not reached the detecting position of the phototube B, and therefore, the light directed from the projection B1 to the receiver B2 (shown by broken line) is not interrupted.

As shown in FIG. 7, each phototube is disposed at such a level as will permit the end of the stocking on the upper or lower pair of templates, as the case may be, to be inserted between the light projector and the light receiver.

Figure 6:
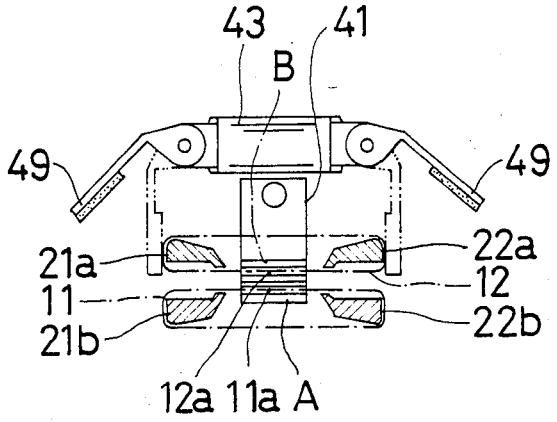
FIG. 6 is an enlarged view taken along the line Y—Y in FIG. 3.

As above described, instantly when the phototube A detects the end 11*a* of one stocking 11 and the moving pedestal 34 and the phototubes fixed integrally therewith are brought to stop, the shafts 47 are rotated through the aforesaid bevel gear by pivoting the lever 53 by the action of the air cylinder 52 so that the positioning plates 49, 49 are swivelled from the solid line position in FIG. 6 to a position shown by alternate long and two short dashes line for abutment with the outer sides of the upper pair of templates 21*a*, 22*a*. Thus, the positioning plates 49, 49 come in pressure contact with the outer sides of end of the other stocking 12.

At the time of detection by the phototube A of the end of the one stocking 11, the phototube B detects the presence or non-presence at its detecting position of the end of the stocking 12 mounted on the upper pair of templates 21*a*, 22*a*. Subsequent operation of the phototube B is explained separately for the following two cases: a first case where the end of the stocking 12 is detected by the phototube B, and a second case where it is not detected.

Figure 8C:
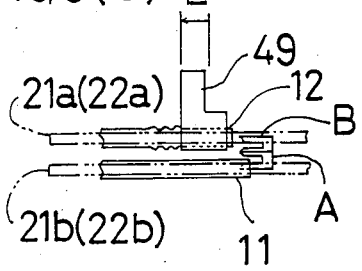
Figure 8:
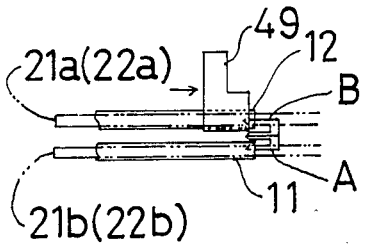

In the first case, that is, where the end of the one stocking 11 mounted on the lower pair of templates 21*b*, 22*b* is positioned nearer to the template end than the end of the other stocking mounted on the upper pair of templates 21*a*, 22*a* as FIG. 8A shows, the end of the stocking 12 is moved toward the front end of the templates so that it is put outside the detecting range of the phototube B, as FIG. 8C shows, and thereafter, the stocking end is moved back toward the base end of the templates, as FIG. 8D shows. When the phototube B again detects the end 12*a* of said other stocking 12 (see FIG. 6), such movement of the stocking 12 is stopped so that the end 12*a* of said other stocking 12 may be properly positioned by aligning it with the end 11*a* of the one stocking 11.

That is, under the condition of the positioning plates 49, 49 holding both sides of the end of said other stocking 12 in pressure contact therewith, the motor 37 on the moving pedestal 34 is driven forward through a suitable timer (not shown) for a certain period, whereby the slider 42, together with the rack 36, is moved a certain distance along the guide shaft 40 independently of the moving pedestal 34. The positioning plates 49, 49 are thus moved over a distance E from the FIG. 8B position to the FIG. 8C position along the outer sides of the upper pair of templates 21*a*, 22*a*.

Accordingly, the end of the other stocking 12 is moved toward the front end of the template assembly until it reaches the FIG. 8C position.

After the lapse of the set time for the timer, the motor is driven reversely to move the positioning plates 49, 49, with the outer sides of the end of said other stocking 12 held in pressure contact thereby, toward the base end of the template assembly. Upon detection by the phototube B of the end 12*a* of the stocking 12 (see FIG. 6), the reverse run of the motor 37 is stopped, whereby the end 12*a* of the stocking 12 is positioned at the detecting position of the phototube B, as FIG. 8D shows.

Thus, the end 12*a* of the stocking 12 has now been positioned on the template assembly and according to the position of the end 11*a* of the stocking 11. The reason is simple. As already stated, the detecting positions of the phototubes A and B are in agreement with each other on the vertical line.

At the end of the positioning operation, the air cylinder 52 is moved reversely to swivel the positioning plates 49, 49 from the alternate long and two short dashes line position in FIG. 6 to the solid line position, so that the end of the stocking 12 is released from the condition of being held in pressure contact with the positioning plates 49, 49.

The slider 42 returns to its original position.

Operation in the second case, that is, in the case where the end of the other stocking 12 is not detected by the phototube B, will now be explained.

If the end of one stocking 11 mounted on the lower pair of templates 21*b*, 22*b* is positioned more remote from the front end of the templates than the end of the other stocking 12 mounted on the upper pair of templates 21*a*, 22*a*, as FIG. 9A shows, the end of said other stocking 12 is moved directly toward the base end of the templates (see FIG. 9C), and when the phototube B detects the end 12*a* of said other stocking 12 (see FIG. 6), the stocking 12 is caused to stop moving, whereby the end of said other stocking 12 is aligned with the end of one stocking 11.

Figure 9C:
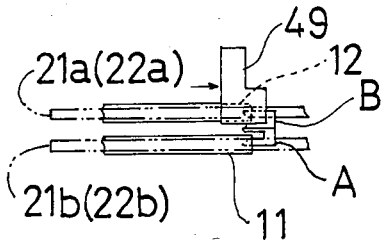

That is, upon detection by the phototube A of the end 11*a* of one stocking 11, if it is determined by the phototube B that the end of the other stocking 12 is not present, the motor 37 is driven reversely to move the positioning plates 49, 49, with the outer sides of the end of said other stocking 12 held in pressure contact thereby, toward the base end of the template assembly; and when the phototube B detects the end 12*a* of the stocking 12 (see FIG. 6), the reverse run of the motor 37 is stopped, the end 12*a* of the stocking 12 is positioned at the detecting position of the phototube B, as FIG. 9C shows. Thus, as explained earlier, the end 12*a* of the stocking 12 is properly positioned on the template assembly on the basis of the end 11*a* of the stocking 11. Concurrently with the completion of positioning of the stocking end 12*a*, the positioning plates 49, 49 are swivelled from the alternate long and two short dashes line position in FIG. 6 to the solid line position to release the end of the stocking 12 from their holding by pressure contact at the outer sides. The slider 42 returns to its original position to stand by for the next cycle of positioning operation.

The motor 35 is driven reversely to allow the moving pedestal 34 to return to its original position to stand by for the next cycle of operation.

In order to improve the operating speed, it is possible to arrange for quick traverse of the moving pedestal 34.

For this purpose, a separate phototube (not shown) may be disposed facing upward at the lower end of the holder 41 through a suitable bracket and at a location nearer to the template unit 20 than the phototubes A, B. Through this arrangement, the mode of operation may be such that the motor 35 is driven forward at high speed at the start of the positioning operation so that the moving pedestal 34 moves at high speed toward the template unit 20; and when the separate phototube detects the end of one stocking 11 mounted on the lower pair of templates 21*b*, 22*b*, the run speed of the motor 35 is changed from high to low to slow down the travel of the moving pedestal 34 toward the template unit 20. Then, the positioning of the stocking by the phototubes A, B is performed in the manner as explained earlier. After completion of this positioning operation, the other stocking 12 is detected and positioned by the phototube B. Subsequently, the positioning plates 49, 49 release the end of the stocking 12 from their holding by pressure contact at the outer sides. Thereafter, the motor 35 is driven reversely at high speed so that the moving pedestal 34 is moved at high speed back to its original position.

In the above description, the end of one stocking 11 is detected by the phototube A and the end of the other stocking 12 as detected by the phototube B is positioned on the basis of the position of end of said one stocking 11. Needless to say, it is possible that the end of said one stocking 11 is positioned on the basis of the position of end of said other stocking 12.

As described above, the present invention makes it possible to automatically perform the operation of stocking end positioning which has heretofore been carried out manually. Not only does the invention serve for improvement of operating efficiency of automatic pantyhose hip-portion seaming machines, but also it can remarkably reduce the labor of workers employed in such operation.

In a pantyhose hip-portion seaming operation, as explained already, stockings mounted on the upper and lower template assemblies and held in superposed relation by nipping are cut at center along the line 15 shown in FIG. 1A and the portions so cut are spread open and then sewn. According to the method and apparatus of the present invention, the center of each stocking end to be cut and opened can be accurately positioned with the aid of upper and lower phototubes and thus possible defects in pantyhose seaming work can be eliminated.

The phototubes employed for positioning according to the invention are of such arrangement that they are suitably insertible into the interior of upper and lower stockings mounted on the upper and lower template assemblies of each template unit so that the lower-side end center 12*a* of the upper stocking 12 (see FIG. 6) and the upper-side end center 11*a* of the lower stocking 11 (see FIG. 6) may detected from the vertical direction. With this arrangement, it is possible to carry out the positioning operation far more accurately than in the case of positioning through phototube detection of stocking ends from outside of the stockings.

Where an attempt is made to detect by phototubes the ends of stockings to be cut and seamed, at a location outside the stockings, it is likely that the involvement of material thickness in the detecting range will render the positioning inaccurate.

The manner in which the stockings are held in pressure contact by the positioning plates is not limited to holding the stocking ends at outer sides thereof and at both sides of the template assemblies. It is also possible to hold the stocking in pressure contact on each template. In this case, however, it is likely that because of the stretchability of stocking material, the upper side material portion will move in precedence to the material portion to be cut and seamed. As such, it is rather difficult to stop the material portion to be cut and seamed to rest exactly at the detecting position of the phototube. On the other hand, where the outer sides of stockings are held in pressure contact at both sides of the template assembly, the material can easily be stopped to at a specified position, which fact permits accurate positioning of stocking ends.

What is claimed is:

1. A method of automatically positioning stocking ends, which comprises mounting a pair of stockings on upper and lower template assemblies of a template unit and thereafter detecting the end of one of the stockings so mounted by means of one phototube A of a pair of phototubes disposed at upper and lower locations, bringing positioning plates into contact with the end of the other stocking upon said detection, causing the other phototube B to detect the presence or non-presence of the other stocking at the time of the detection of said one stocking by said one phototube A, moving the end of the other stocking, if the end is detected by said other phototube B, over a preset distance toward the front end of the template assembly, then moving said stocking end toward the base end of the template assembly and to the detecting position of the other phototube B, and conversely, if the other stocking end is not detected by said other phototube B, moving said one stocking end toward the base end of the template assembly by means of the positioning plates, and disengaging said positioning plates from the end of said other stocking at the time when the end of said other stocking is detected by said other phototube B.

2. An apparatus for automatically positioning the ends of a pair of stockings, comprising: a template unit having upper and lower template assemblies; a pedestal; means for moving said pedestal back and forth in the longitudinal direction of the upper and lower template assemblies; at least two phototubes A and B disposed on said pedestal for optically detecting the ends of a pair of stockings mounted on said upper and lower templates; a slider disposed on said pedestal; means for moving said slider back and forth in the same direction as said pedestal and independently of said pedestal; and positioning plates mounted on said slider and being selectively engageable with the end of a stocking mounted on one of said template assemblies of said template unit, for positioning said stocking with respect to the other of said pair of stockings in response to a signal from one of said phototubes, and disengageable therefrom in response to a signal from the other of said phototubes.

* * * * *